US009773633B2

(12) United States Patent
Jordan et al.

(10) Patent No.: US 9,773,633 B2
(45) Date of Patent: Sep. 26, 2017

(54) COMPACT FUSE SUPPORT

(71) Applicant: SCHNEIDER ELECTRIC USA, INC., Palatine, IL (US)

(72) Inventors: Jeffrey T. Jordan, Franklin, TN (US); Gregory O. Motley, Murfreesboro, TN (US)

(73) Assignee: Schneider Electric USA, Inc., Andover, MA (US)

( * ) Notice: Subject to any disclaimer, the term of this patent is extended or adjusted under 35 U.S.C. 154(b) by 136 days.

(21) Appl. No.: 14/658,219

(22) Filed: Mar. 15, 2015

(65) Prior Publication Data

US 2016/0268090 A1 Sep. 15, 2016

(51) Int. Cl.

| | |
|---|---|
| ***H01H 85/175*** | (2006.01) |
| ***H01H 85/20*** | (2006.01) |
| *H01H 85/042* | (2006.01) |
| *H01H 85/02* | (2006.01) |

(52) U.S. Cl.

CPC ..... *H01H 85/202* (2013.01); *H01H 85/042* (2013.01); *H01H 2085/0225* (2013.01)

(58) Field of Classification Search

CPC .. H01H 85/175; H01H 85/202; H01H 85/042; H01H 2085/0225

USPC ..... 337/186, 204

See application file for complete search history.

(56) References Cited

U.S. PATENT DOCUMENTS

| | | | | | |
|---|---|---|---|---|---|
| 737,283 | A * | 8/1903 | Sachs | H01H 85/2045 | 361/833 |
| 2,337,872 | A * | 12/1943 | Craig | H01H 85/42 | 337/204 |
| 2,504,876 | A * | 4/1950 | Pringle | H02B 11/127 | 126/340 |
| 2,704,795 | A * | 3/1955 | Miller | H01H 9/102 | 337/190 |
| 2,842,640 | A * | 7/1958 | Ragan | H01H 19/635 | 200/330 |
| 2,914,627 | A * | 11/1959 | Eichelberger | H01H 9/10 | 200/50.25 |
| 2,917,677 | A * | 12/1959 | Washil | H02B 11/133 | 200/50.23 |
| 3,202,788 | A * | 8/1965 | George | H01H 9/102 | 337/194 |

(Continued)

*Primary Examiner* — Anatoly Vortman

(74) *Attorney, Agent, or Firm* — Locke Lord LLP

(57) ABSTRACT

Method and apparatus for mounting fuses in switchgear and similar electrical isolation equipment provide a nonconductive fuse support that allows the fuses to be mounted separately from the transformers. Two such fuse supports may be used to support a fuse, one fuse support for each fuse terminal. Each fuse support may support two fuse terminals so dual fuses may be supported by the same pair of fuse supports. The fuse supports substantially surround the fuse terminals to provide an insulating barrier that helps prevent electrical discharge and also ensure sufficient spacing between the fuse terminals and ground or other conductors in the switchgear. Such an arrangement allows the fuses and transformers to fit within a reduced space in the switchgear and similar electrical isolation equipment while complying with industry-standard performance requirements. The fuse supports are preferably noncontiguous, thereby leaving the nonconductive portion of the fuse physically unsurrounded.

14 Claims, 6 Drawing Sheets

(56) References Cited

U.S. PATENT DOCUMENTS 3,354,356 A * 11/1967 Pettit ..... H01H 9/10 335/6
3,363,147 A * 1/1968 Cataldo ..... G01R 31/006 200/50.39
3,896,353 A * 7/1975 Burton ..... H02B 1/36 200/50.26
3,916,258 A * 10/1975 Westrom ..... H02H 5/06 337/208
3,953,818 A * 4/1976 Martin ..... H01F 27/402 337/191
3,990,031 A * 11/1976 Benton ..... H01F 27/04 337/186
4,059,816 A 11/1977 Bonecutter et al.
4,360,848 A * 11/1982 Noutko ..... H01H 85/0241 361/15
4,675,771 A * 6/1987 Huber ..... H01H 33/666 361/104
4,975,797 A * 12/1990 Veverka ..... H01F 27/04 361/127
5,116,246 A * 5/1992 Perry ..... H01H 85/2045 337/209
5,119,060 A * 6/1992 Bzdak ..... H01H 85/055 337/217
5,181,158 A 1/1993 Goe, Jr. et al.
5,594,403 A * 1/1997 Taga ..... H01H 85/20 337/186
5,982,267 A * 11/1999 Locht ..... H01H 85/20 337/186
8,018,317 B2 9/2011 Lindqvist et al.
8,692,645 B2 * 4/2014 Ciesielski ..... H01F 27/402 337/142
2005/0260886 A1 * 11/2005 Persits ..... H01H 85/547 439/521
2008/0264513 A1 * 10/2008 Lin ..... H01B 13/01227 140/92.1
2009/0091416 A1 * 4/2009 Tang ..... H01H 31/127 337/171
2012/0113569 A1 * 5/2012 Peralta ..... H02G 5/10 361/676

* cited by examiner

COMPACT FUSE SUPPORT

FIELD OF THE INVENTION

The disclosed embodiments relate generally to switchgear and similar electrical isolation equipment, and particularly to methods and apparatuses for reducing the amount of space required to mount fuses and similar current-limiting devices in such isolation equipment.

BACKGROUND OF THE INVENTION

Switchgear and similar electrical isolation equipment are highly regulated by industry standards (e.g., IEEE, ANSI, etc.). Among other things, these standards require line-side (upstream) current-limiting fuses for voltage transformers ("VT") used as sensors to monitor the condition and quality of power in medium voltage switchgear. Such fuses frequently resemble a tube having conductive terminals on each end and are typically mounted directly onto the voltage transformers in the switchgear cabinet. The industry standards also define the minimum clearance or spacing required in the absence of substantiating test documentation between exposed portions of adjacent conductors, such as adjacent electrical power buses, as well as from those conductors to ground for various voltage levels. The clearances are described in terms of direct or "strike" distances and linear surface or "tracking" distances.

Direct mounting of fuses onto the voltage transformers requires space in the switchgear. However, customer preferences for smaller and less expensive switchgear continue to push manufacturers toward ever smaller switchgear. As an example, for mature switchgear like the Masterclad™ series of medium voltage metal-clad switchgear from Schneider Electric USA, Inc., the voltage transformers and tubular fuses reside within a compartment that measures roughly 36 inches wide by 42 inches tall. On the other hand, smaller switchgear like the HVL/cb™ series of metal-enclosed switchgear from Schneider Electric USA require the voltage transformer and tubular fuse to fit within a compartment that is about half the size. This makes it difficult, if not impractical, to mount fuses directly onto voltage transformer in small footprint switchgears.

Similar challenges exist for other types of transformers in small footprint switchgears. For example, control power for breaker controls (e.g., relays, controllers, etc.) is often derived from the medium voltage switchgear primary circuit. The devices that convert power from the switchgear are commonly called control power transformers ("CPT") and are generally larger than voltage transformers. As a result, it is especially difficult to mount fuses directly onto CPTs in small footprint switchgears. The above difficulty is compounded by the imperative also to comply with industry-standard clearance or performance requirements.

Thus, a need exists for a way to mount transformer fuses in small footprint switchgear and similar electrical isolation equipment where the space allocated for the fuses and transformers is limited while also complying with industry-standard performance requirements.

SUMMARY OF THE DISCLOSED EMBODIMENTS

The embodiments disclosed herein are directed to a method and apparatus for mounting fuses that protect transformers in switchgear and similar electrical isolation equipment. The method and apparatus provide a nonconductive fuse support that allows the tubular fuses to be mounted separately from, instead of directly on, the transformers. Two such fuse supports may be used to support a fuse, each fuse support supporting one fuse terminal. Alternatively, each fuse support may support two fuse terminals so dual fuses may be supported by the same pair of fuse supports. The fuse supports substantially surround the fuse terminals to provide an insulating barrier that helps prevent electrical discharge and also ensure sufficient spacing between the fuse terminals and ground or other conductors in the switchgear. Such an arrangement allows the fuses and transformers to fit within a reduced space in the switchgear and similar electrical isolation equipment while complying with industry-standard performance requirements.

In some embodiments, each nonconductive fuse support includes an open-ended housing made of a plastic or similar nonconductive material having a top wall, a bottom wall, and two side walls that form a generally rectangular tube. The housing has an elongated, generally cylindrical support structure also made of plastic or similar nonconductive material extending away from an exterior surface of the bottom wall substantially perpendicularly thereto. The elongated support structure helps keep the housing and the fuse terminal therein separated from any live or grounded components, such as a panel or wall in the switchgear, by a predefined strike distance when the fuse support is installed in the switchgear.

In some embodiments, the elongated support structure may include a neck portion and a base portion extending from the neck portion. The base portion is designed to be attached or otherwise fastened to a panel or wall within the switchgear and may have a larger diameter than the neck portion for greater stability. Either or both the base portion and the neck portion may have coaxial, radially extending insulating discs or sheds disposed thereon that function to increase the tracking distance along the outer surface of the elongated support structure. A first set of screw holes may be drilled or otherwise provided on an underside of the base portion to facilitate attaching it to the panel or wall in the switchgear.

A second set of screw holes may similarly be drilled or otherwise provided in the bottom wall of the housing on an interior surface thereof in some embodiments for screwing or otherwise attaching a bracket to the housing. The screw holes extend into, but do not pass through, a screw receiving channel integrally disposed on the exterior surface of the bottom wall at or near the point where the elongated support structure meets the bottom wall. The screw receiving channel helps prevent any screws or fasteners in the screw holes from breaking through so no potentially conductive components are exposed on the exterior surface of the housing, thereby maintaining the structural and insulating integrity of the fuse support.

The bracket may be part of a mounting assembly that helps hold a fuse between the fuse supports. The mounting assembly includes a pair of brackets, one bracket for each fuse support, and two conductive end caps, one end cap on each bracket, for receiving the fuse terminals of the fuse. One of the end caps may be fixed to one of the brackets while the other end cap be releasably attached to the second bracket via a suitable locking mechanism, such as a quarter-turn locking mechanism. The end caps may be field-shaping end caps that have mostly or only smooth and rounded surfaces so there are no hard or sharp edges or corners from which electrical discharge from/to ground or other conductors may occur. This use of smooth and rounded surfaces allows the end caps and thus the fuse terminals to be located nearer to ground or other conductors than would conventionally be the case.

In general operation, to mount a fuse, a pair of fuse supports is attached or otherwise fastened to the panel or wall in the switchgear so their respective brackets line up opposite from each other. One fuse terminal is then inserted in the fixed end cap on one of the bracket while the non-fixed end cap is placed over the opposite fuse terminal. The non-fixed end cap is then inserted in the second bracket and locked, for example, by a quarter-turn twist to secure the fuse between the two fuse supports. It is also possible to secure the fuse between the pair of fuse supports first and then attach or otherwise fasten the fuse supports to the panel or wall in the switchgear.

In general, in one aspect, the disclosed embodiments relate to a fuse support for mounting a tubular fuse in electrical isolation equipment. The fuse support comprises, among other things, an open-ended housing having a top wall, a bottom wall, and two side walls forming a generally rectangular tube and an elongated support structure extending from an exterior surface of the bottom wall of the housing substantially perpendicular thereto. The fuse support further comprises a terminal bracket attached to the bottom wall of the housing on an interior surface thereof over the elongated support structure and a cup shaped end cap attached to the bracket for receiving a fuse terminal of the tubular fuse, the cup shaped end cap having smooth and rounded surfaces that minimize or prevent electrical discharge through the end cap.

In general, in another aspect, the disclosed embodiments relate to a switchgear module. The switchgear module comprises, among other things, a panel, a fuse assembly attached to the panel, a mounting assembly disposed in the fuse assembly, and a fuse having a fuse terminal at each opposing end thereof, the fuse secured to the mounting assembly such that said fuse is mounted separately from any transformer attached to the panel.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1A:
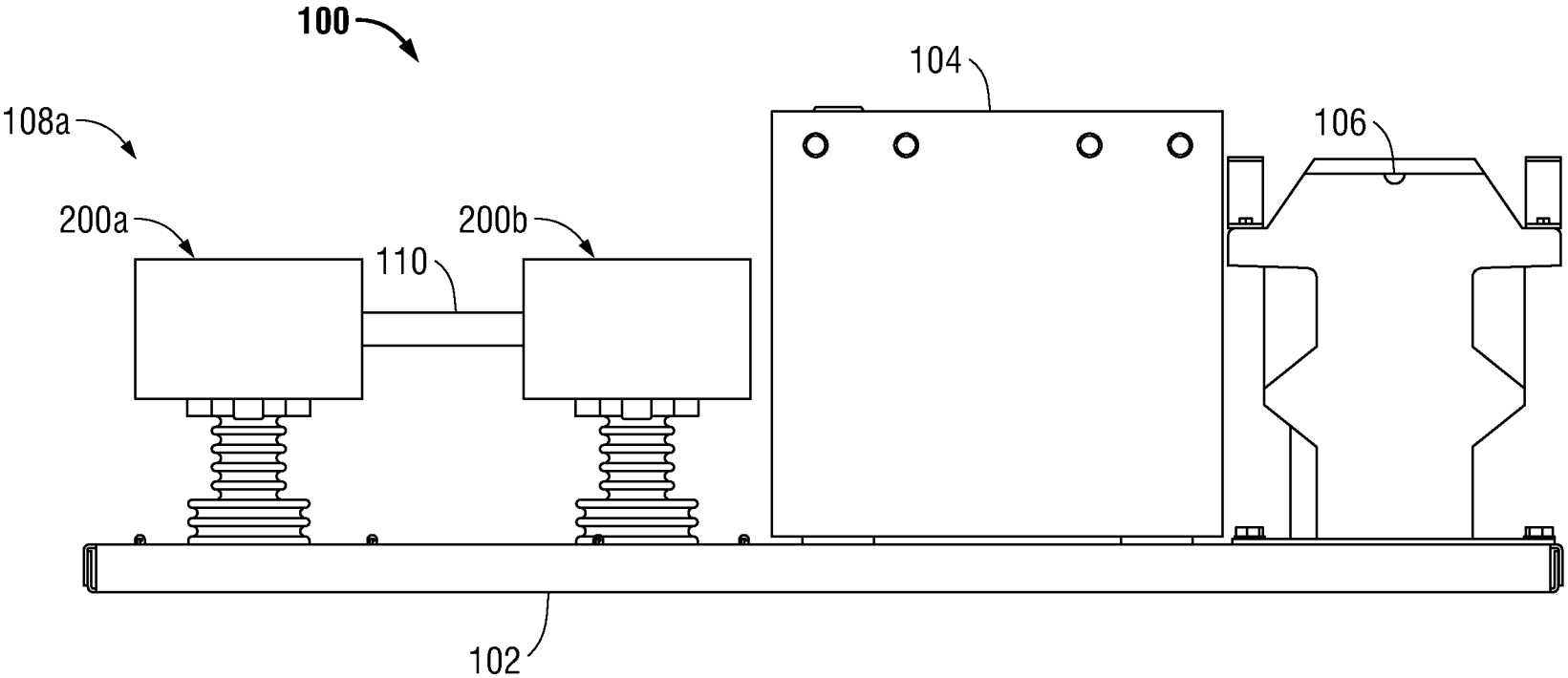
FIGS. 1A, 1B, and 1C are side, top, and front views, respectively, of a switchgear module having fuse supports according to some implementations of the disclosed embodiments.

Referring first to FIG. 1A, a side view of an exemplary module for a medium voltage switchgear (not expressly shown) according to the disclosed embodiments is shown. The switchgear module 100 comprises a grounded panel 102 on which a transformer unit 104 having one or more voltage transformers (not expressly shown) therein is attached or otherwise fastened along with other medium voltage switchgear equipment 106. It should be understood that any reference to medium voltage switchgear, that is, switchgear with voltage ratings generally between 1 kV-35 kV, is illustrative only and that the principles and concepts discussed herein are also applicable to low and high voltage ratings.

One or more exemplary fuse assemblies, one of which is indicated at 108*a*, are also attached or otherwise fastened on the panel 102 in accordance with the disclosed embodiments. The fuse assembly 108*a* includes a pair of exemplary fuse supports 200*a* & 200*b* that hold or otherwise secure at least one current-limiting fuse 110 therebetween. As can be seen, the nonconductive fuse supports 200*a* & 200*b* are located separately from the transformer unit 104 so the fuse 110 is not mounted directly on a transformer within the transformer unit 104. The mounting of the fuse 110 separately from the transformer allows the overall size of the switchgear module 100 to be reduced, making it possible or at least easier for the switchgear module 100 to fit within a smaller compartment compared to existing solutions. For example, the exemplary switchgear module 100 shown here may fit within a compartment that measures only 17 inches wide by 45 inches tall, such as may be found in the HVL/cb™ series of metal-enclosed switchgear from Schneider Electric USA, Inc., or similar metal-enclosed and metal-clad switchgear.

Figure 1B:
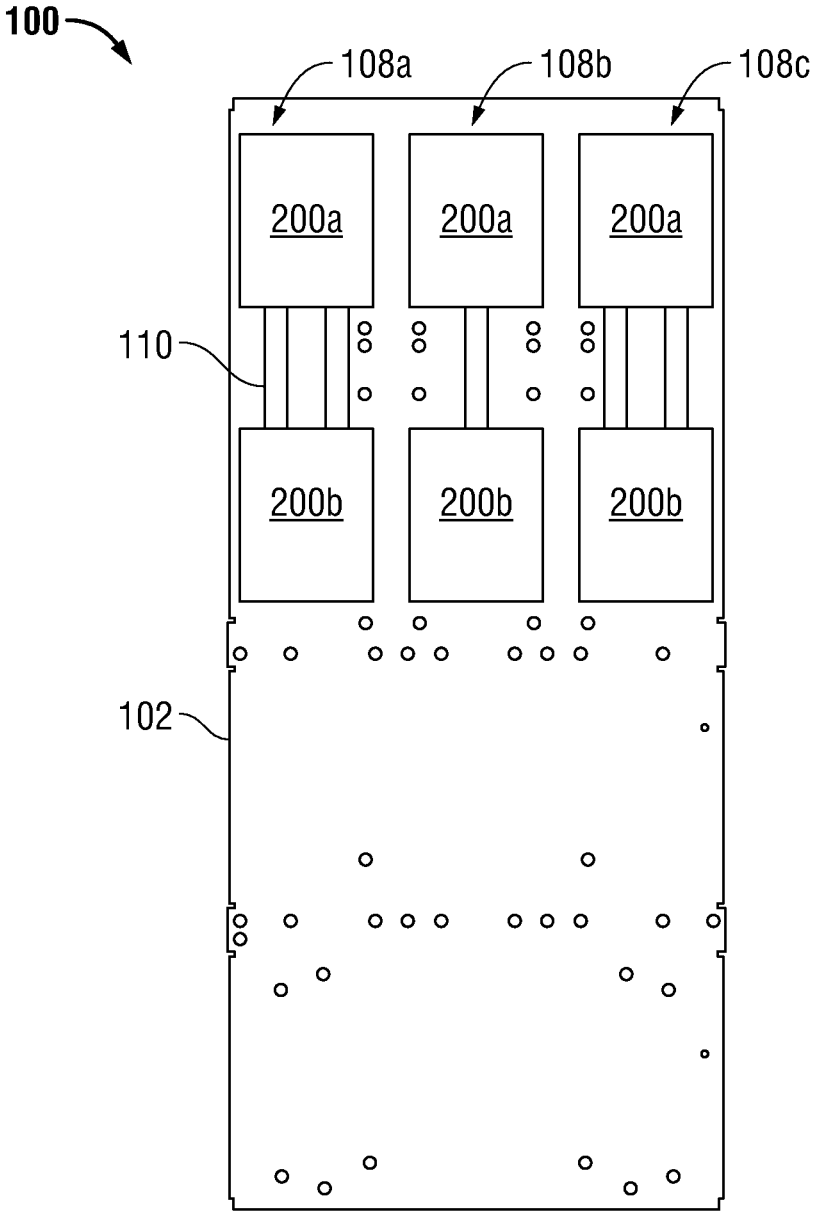

FIG. 1B depicts the switchgear module 100 looking down from the top of the panel 102, with the transformer unit 104 and other electrical equipment 106 removed from the panel 102 for clarity. As this view shows, there are three fuse assemblies 108*a*, 108*b*, and 108*c* on the panel 102, each fuse assembly comprising a pair of virtually identical fuse supports 200*a* & 200*b*. Each fuse support 200*a* & 200*b* houses a fuse terminal for at least one tubular fuse 110 to secure the fuse therebetween. Only the nonconductive middle portions of the fuses 110 are visible, the conductive fuse terminals being hidden from view by the fuse supports 200*a* & 200*b*. In the example shown, the left fuse assembly 108*a* and the right fuse assembly 108*c* each support two fuses 110 while the middle fuse assembly 108*b* supports a single fuse 110. An alternative number of fuse assemblies and/or fuses per fuse assembly may of course be deployed depending on the needs of the particular switchgear application without departing from the scope of the disclosed embodiments.

Figure 1C:
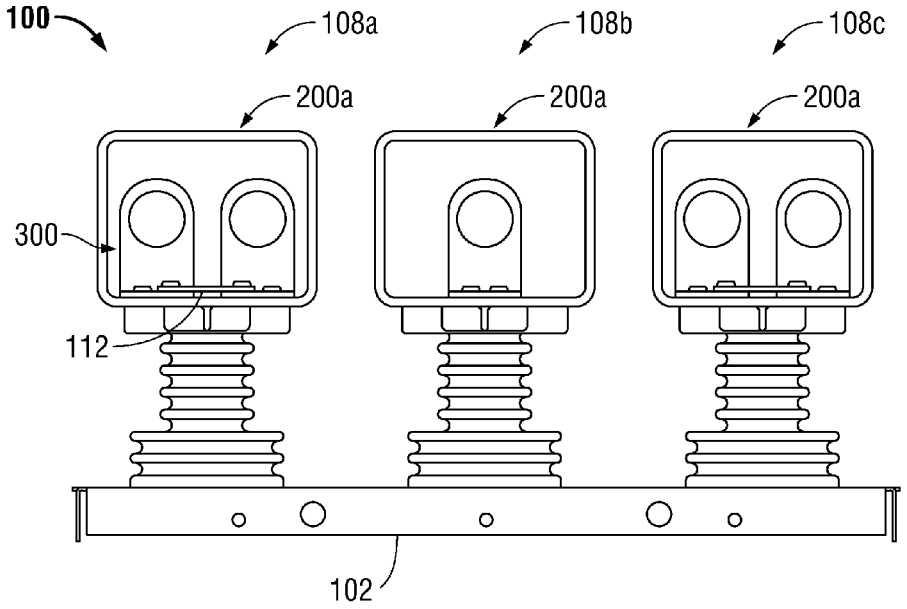

FIG. 1C shows a view of the switchgear module 100 as seen from the front of the panel 102 such that only one fuse support 200*a* from each of the fuse assemblies 108*a*, 108*b*, and 108*c* is visible. From this angle, it can be seen that each fuse assembly 108*a*, 108*b*, and 108*c* further comprises at least one mounting assembly 300 therein to which a fuse 110 (not visible here) may be physically and electrically connected. As will be more readily discerned from FIG. 4, the fuse supports 200*a* & 200*b* substantially surround the fuse terminals (not visible here) to provide an insulating barrier that helps prevent electrical discharge and also ensure sufficient spacing between the fuse terminals and ground or other conductors in the switchgear. Where two fuses 110 and hence two mounting assemblies 300 are employed in a given fuse assembly 108*a*, 108*b*, or 108*c*, a conductive plate 112 may be used to connect the dual mounting assemblies together and thus electrically connect the fuses 110 together in the fuse assembly.

Figure 2A:
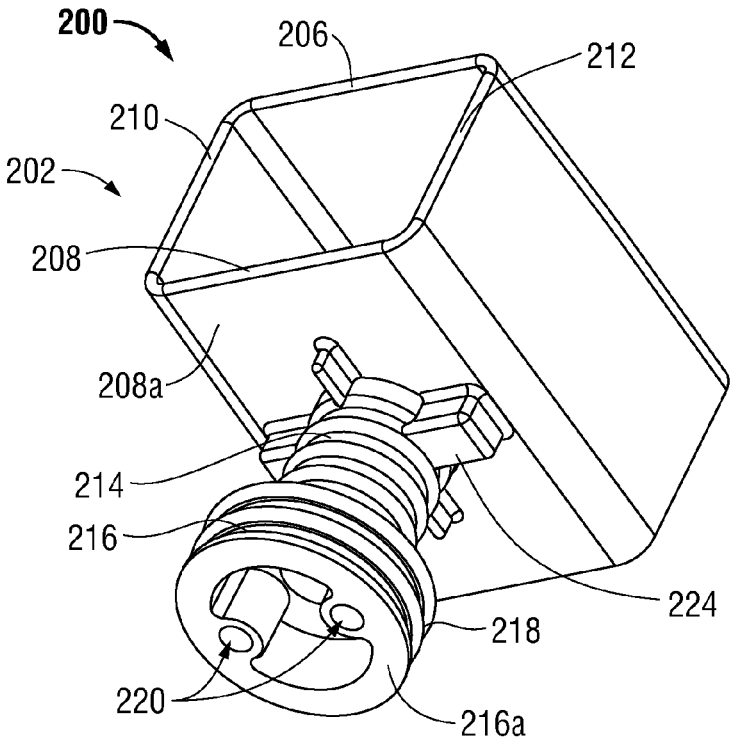
FIGS. 2A and 2B are bottom and top perspective views, respectively, of a fuse support according to some implementations of the disclosed embodiments.
Figure 2B:
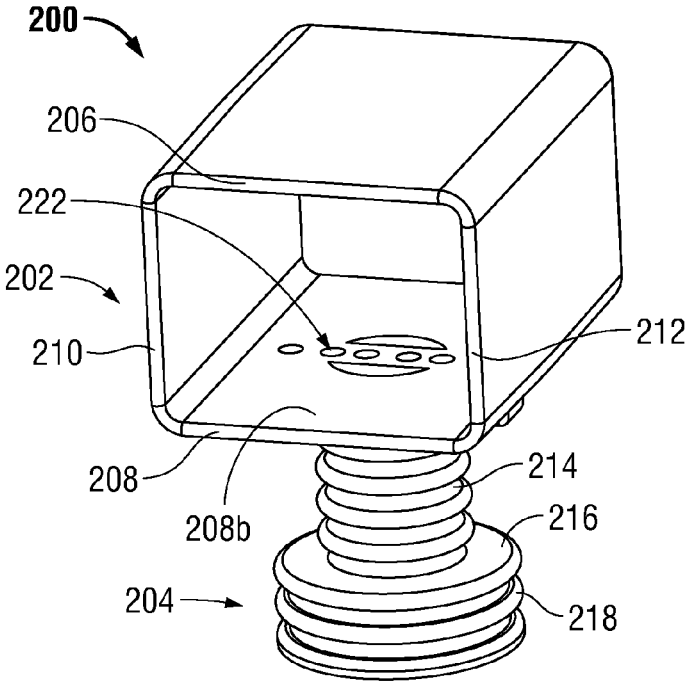

Turning now to FIGS. 2A and 2B, perspective views of an exemplary fuse support 200 are shown according to the disclosed embodiments. The fuse support 200 includes two main sections, an open-ended housing 202 and an elongated, generally cylindrical support structure 204 extending perpendicularly away from the housing 202. The housing 202 may resemble a generally rectangular tube having a top wall 206, a bottom wall 208, and two side walls 210 and 212 and may be made of a plastic or similar nonconductive material. The elongated support structure 204, which may be made of the same nonconductive material, extends from an exterior surface 208*a* of the bottom wall 208 near the center thereof and helps keep the housing 202 (and the fuse terminal therein) separated from the panel 102 and other conductors in the switchgear by a predefined clearance or strike distance.

In some embodiments, the elongated support structure 204 may also include two main sections, a neck portion 214 and a base portion 216 extending coaxially from the neck portion 214. The base portion 216 is designed to be attached or otherwise fastened to the panel 102 and in some embodiments may have a larger diameter than the neck portion 214 for better stability. Either or both the base portion 216 and the neck portion 214 may have coaxial, radially extending insulating discs or sheds 218 disposed thereon that function to increase the tracking distance along the outer surface of the elongated support structure 204. A first set of screw holes 220 may be drilled or otherwise provided on an underside 216*a* of the base portion 216 to facilitate screwing or otherwise attaching it to the panel 102.

A second set of screw holes 222 may also be drilled or otherwise provided in the bottom wall 208 of the housing 202 on an interior surface 208*b* thereof in some embodiments for screwing or otherwise attaching a terminal bracket (302 and 304, discussed in FIG. 3) to the housing 202. The screw holes 222 extend into, but do not go through, a bar shaped screw receiving channel 224 formed or otherwise integrally disposed on the exterior surface 208*a* of the bottom wall 208 at or near the point where the elongated support structure 204 meets the bottom wall 208. The screw receiving channel 224 helps prevent any screws or fasteners from breaking through the housing 202 so no potentially conductive components are exposed on the exterior surface 208*a* of the housing 202, thus preserving the structural and insulating integrity of the fuse support 200.

Figure 3:
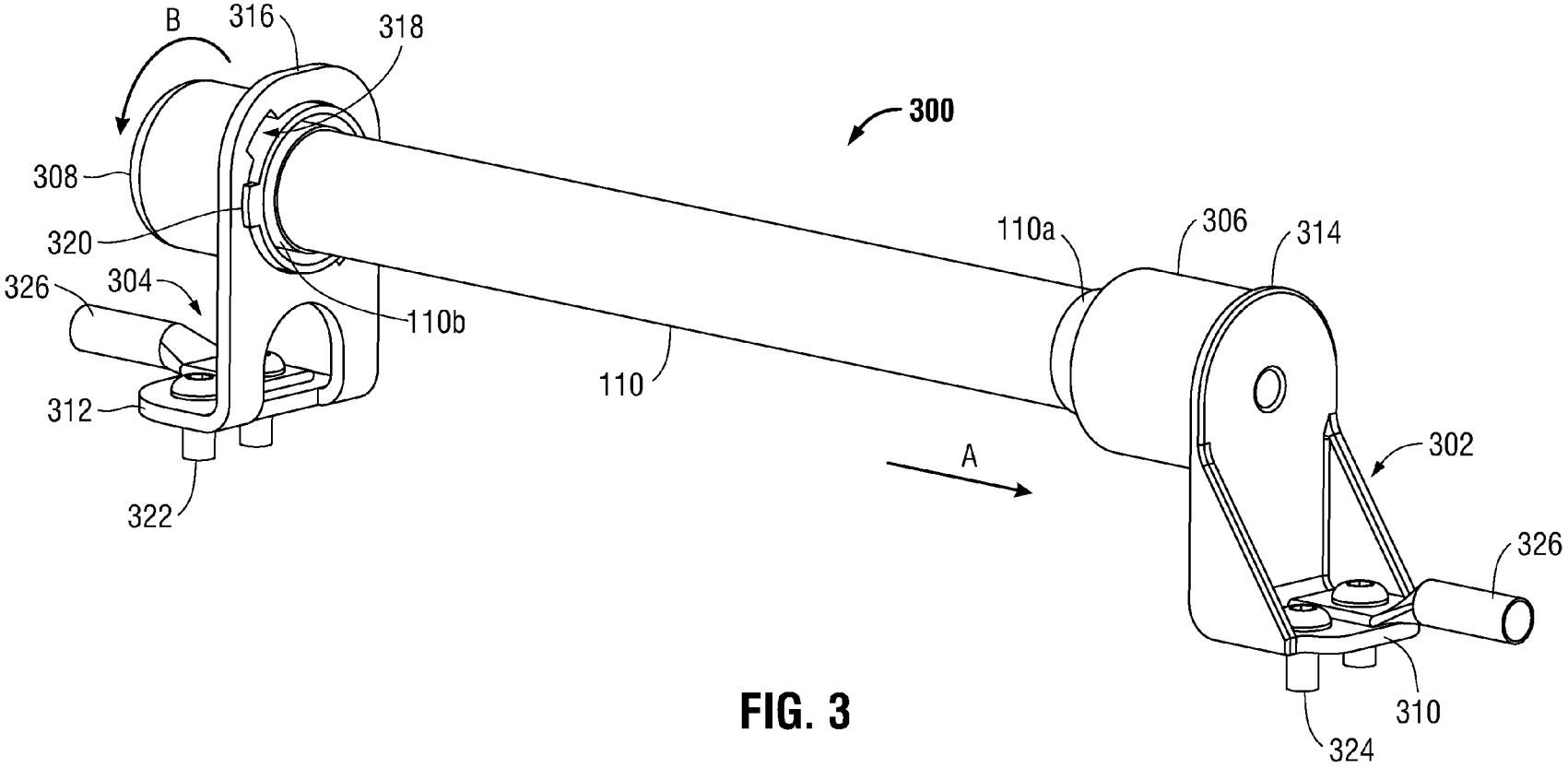
FIG. 3 is a perspective view of a mounting assembly that may be used with the fuse supports herein according to some implementations of the disclosed embodiments.
Figure 4:
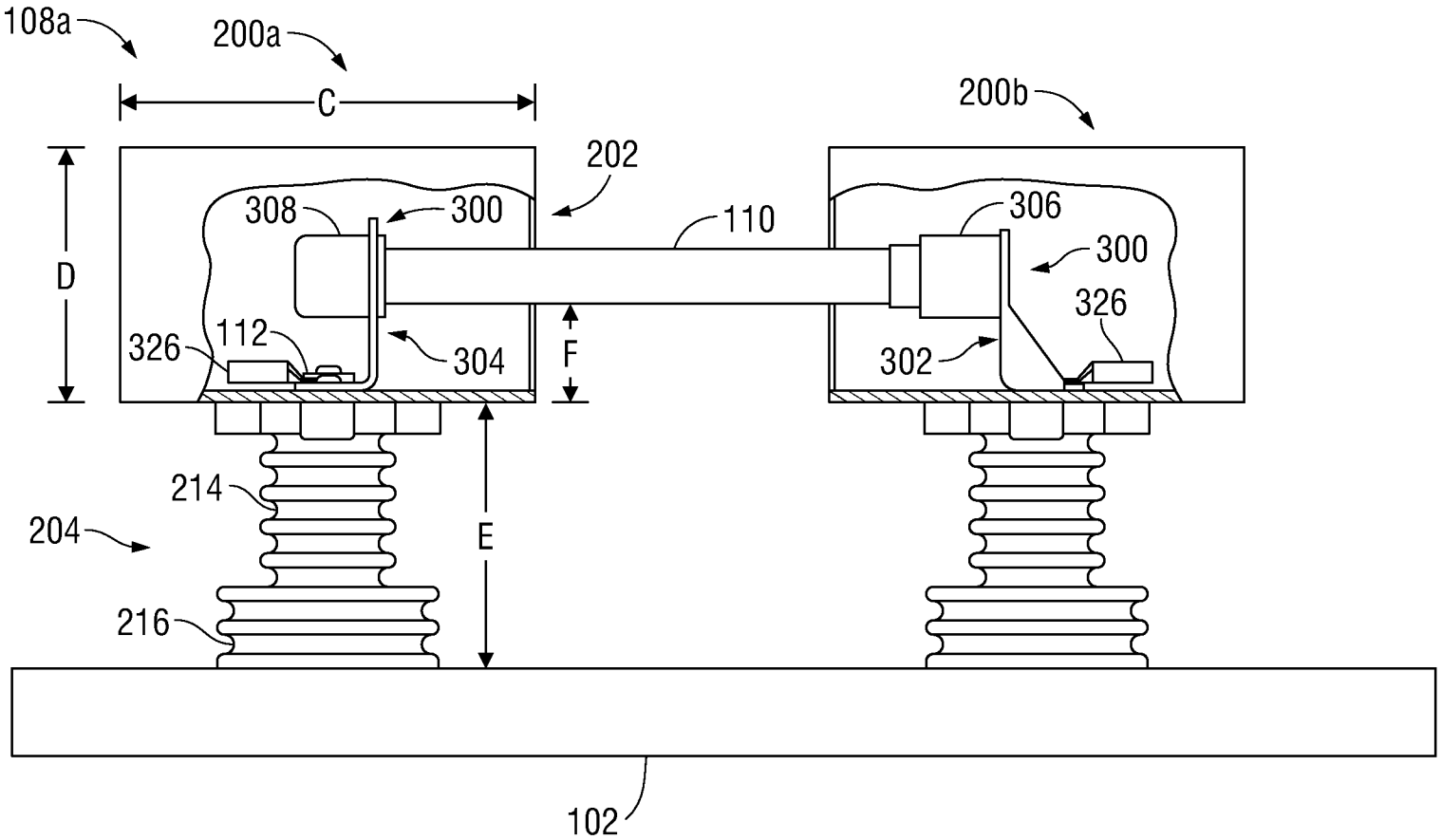
FIG. 4 is cut away view of a fuse assembly according to some implementations of the disclosed embodiments.

The terminal bracket mentioned above may be part of a mounting assembly 300, depicted in FIG. 3, that helps hold the fuse 110 between two fuse supports 200*a* & 200*b* (as shown in FIG. 4). The mounting assembly 300 includes two generally L-shaped terminal brackets 302 and 304, one for each fuse terminal, and two generally cup-shaped end caps 306 and 308, one end cap on each bracket 302 and 304, respectively, for receiving the fuse terminals of the fuse 110. The conductive end caps 306 and 308 may be field-shaping end caps that have mostly or only smooth and rounded surfaces so there are no hard or sharp edges or corners from which through-air electrical discharge from/to ground or other conductors may occur. This use of smooth and rounded surfaces allows the end caps and thus the fuse terminals therein to be located nearer to ground or other conductors than would otherwise be the case.

Each terminal bracket 302 and 304 has a generally flat base 310 and 312, respectively, that may be fastened to the housing 202 of the fuse support 200 and a generally flat mounting plate 314 and 316, respectively, extending perpendicularly from the base 310 and 312 for supporting the end caps 306 and 308. One of the end caps, for example, the right end cap 306, may be fixedly attached (e.g., welded, etc.) to the first terminal bracket, for example, the right bracket 302, on the mounting plate 314 thereof. The mounting plate 316 of the second terminal bracket 306 may have a circular opening formed therein (not expressly labeled) for receiving the non-fixed end cap 308. A locking mechanism, such as a quarter-turn locking mechanism, may be used to releasably attach the non-fixed end cap 308 to it its respective terminal bracket 304. For example, the second terminal bracket 304 may have a notch 318 formed in the opening in the mounting plate 316 thereof and the non-fixed end cap 308 may have a tab 320 protruding therefrom that corresponds to the notch 318. Inserting the non-fixed end cap 308 so the tab 320 passes through the notch 318 and rotating it a quarter turn locks the non-fixed end cap 308 in the second terminal bracket 304.

In general operation, to mount a fuse 110, a pair of discrete, noncontiguous fuse supports 200 (see FIGS. 2A and 2B) is attached or otherwise fastened to the panel 102 in the switchgear so their brackets 302 and 304 line up opposite one another. One fuse terminal 110*a* of the fuse 110 is then inserted in the fixed end cap 306 as indicated by the arrow "A." The non-fixed end cap 308 is placed over the opposite fuse terminal 110*b* and inserted in the bracket 304 having the notch 318 therein. This non-fixed end cap 308 is then turned a quarter turn as indicated by the arrow "B" to lock it to the notched bracket 304 and thereby secure the fuse 110 between the two fuse supports. Alternatively, the fuse 110 may be secured between a pair of fuse supports first before attaching or otherwise fastening the fuse supports to the panel 102. One or more screws 322 and 324 may be used to secure the brackets 302 and 304 to their respective fuse supports. The screws 322 and 324 may also be used to attach a cable lug or similar connector 326 to each one of the terminal brackets 302 and 304 to establish an electrical connection to the fuse 110. An insulated conductor cable or the like (not expressly shown) may then be attached to the lug 326 for each terminal bracket 302 and 304 to carry current through the fuse 110.

FIG. 4 shows the exemplary fuse assembly 108*a* from FIG. 1A, but with portions of the fuse supports 200*a* & 200*b* removed in order better to see the mounting assembly 300. In the example shown, each fuse support housing 202 may have a length "C" of about 6.5 inches, a height "D" of about 4.0 inches, and a width of about 5.0 inches for a fiberglass or ceramic ferrule-mounted, current-limiting protection type fuse in a 15 kV rated system. The height "E" of the elongated support structure 204 may be about 4.0 inches, with the height and outer diameter of the neck portion 214 (e.g., 2.25 inches and 2.11 inches, respectively) and the height and outer diameter of the base portion 216 (e.g., 1.17 inches and 3.50 inches, respectively) being selected as needed for a particular switchgear application. The clearance "F" between each end cap 306 and 308 and the walls of the housing 202 may be about 1.0 inch in some embodiment.

The embodiments disclosed herein provide a number of advantages and benefits. Among other things, the field-shaping end caps 306 and 308 have been observed to limit the electric fields around the fuse terminals to about 2 kV/mm, which allows a clearance of about 1.0 inch (25 mm) between the fuse terminals 110*a* and 110*b* (see FIG. 3) and the housing 202 (see FIG. 2) of the fuse support for a 15 kV-rated switchgear. This clearance along with the shape of the fuse support ensures that the 2 kV/mm threshold is not exceeded when the fuse support is placed at least 1.0 inch away from a live conductor or ground. By capping only the fuse terminals and taking advantage of the nonconductive middle portion of the fuse 110, which is typically made of glass, ceramic, or fiberglass, the disclosed embodiments provide a way to protect fuses from undesirable electrical discharges as well as providing ease of physical access to the fuses. Additionally, the generally hollow rectangular shape of the fuse support also provides a barrier around the fuse terminal to avoid an arc event resulting from inadequate strike distance to ground or live conductors.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the disclosed embodiments as defined in the appended claims.

What is claimed is:

1. A switchgear module, comprising:

a panel with a transformer unit mounted thereon;

a fuse assembly attached to the panel;

a mounting assembly disposed in the fuse assembly; and a fuse having a fuse terminal at each opposing end thereof, the fuse secured to the mounting assembly such that said fuse is mounted separately from the transformer unit;

wherein the fuse assembly comprises a pair of noncontiguous fuse supports, each fuse support having an open-ended tubular housing substantially surrounding one of the fuse terminals, the housing providing an insulating barrier around said fuse terminal;

wherein the mounting assembly comprises a pair of terminal brackets, each bracket attached to one of the open-ended housings on an interior surface thereof; and wherein the mounting assembly further comprises first and second end caps for receiving the fuse terminals therein, each end cap attached to one of the terminal brackets, each end cap having smooth and rounded surfaces that minimize or prevent electrical discharge through the end cap.

2. The switchgear module of claim 1, wherein each fuse support further comprises an elongated support structure extending from an exterior surface of the housing substantially perpendicular thereto.

3. The switchgear module of claim 2, wherein the elongated support structure comprises a neck portion and a base portion extending coaxially from the neck portion substantially perpendicular thereto, the base portion having a larger outer diameter than the neck portion.

4. The switchgear module of claim 1, wherein the first end cap is fixedly attached to one of the terminal brackets and the second end cap is releasably attached to one of the terminal brackets via a locking mechanism.

5. The switchgear module of claim 1, further comprising a second mounting assembly disposed in the fuse assembly.

6. The switchgear module of claim 5, further comprising a second fuse secured to the second mounting assembly such that said second fuse is mounted separately from any transformer attached to the panel.

7. A switchgear module, comprising:

a panel with a transformer unit mounted thereon;

a fuse assembly attached to the panel;

a mounting assembly disposed in the fuse assembly; and a fuse having a fuse terminal at each opposing end thereof, the fuse secured to the mounting assembly such that said fuse is mounted separately from the transformer unit; and wherein the fuse assembly comprises a pair of noncontiguous fuse supports, each fuse support having an open-ended tubular housing substantially surrounding one of the fuse terminals, the housing providing an insulating barrier around said fuse terminal.

8. The switchgear module of claim 7, wherein each fuse support further comprises an elongated support structure extending from an exterior surface of the housing substantially perpendicular thereto.

9. The switchgear module of claim 8 wherein the elongated support structure comprises a neck portion and a base portion extending coaxially from the neck portion substantially perpendicular thereto, the base portion having a larger outer diameter than the neck portion.

10. The switchgear module of claim 7, wherein the mounting assembly comprises a pair of terminal brackets, each bracket attached to one of the open-ended housings on an interior surface thereof.

11. The switchgear module of claim 10, wherein the mounting assembly further comprises first and second end caps for receiving the fuse terminals therein, each end cap attached to one of the terminal brackets, each end cap having smooth and rounded surfaces that minimize or prevent electrical discharge through the end cap.

12. The switchgear module of claim 11, wherein the first end cap is fixedly attached to one of the terminal brackets and the second end cap is releasably attached to one of the terminal brackets via a locking mechanism.

13. The switchgear module of claim 7, further comprising a second mounting assembly disposed in the fuse assembly.

14. The switchgear module of claim 13 further comprising a second fuse secured to the second mounting assembly such that said second fuse is mounted separately from any transformer unit attached to the panel.

* * * * *